United States Patent [19]

Seager

[11] 4,261,487

[45] Apr. 14, 1981

[54] POUR THROUGH STOPPER

[75] Inventor: Richard Seager, Mystic, Conn.

[73] Assignee: King Seeley Thermos Co., Prospect Heights, Ill.

[21] Appl. No.: 77,680

[22] Filed: Sep. 21, 1979

[51] Int. Cl.[3] ..... B67D 3/00

[52] U.S. Cl. ..... 222/520; 215/329; 222/318

[58] Field of Search ..... 222/499, 519, 520, 521, 222/525, 545, 549, 551, 318; 215/310, 314, 329

[56] References Cited

U.S. PATENT DOCUMENTS

| | | | |
|---|---|---|---|
| 2,060,622 | 11/1936 | Jones | 222/521 |
| 2,591,231 | 4/1952 | Boadway | 222/521 |
| 3,010,619 | 11/1961 | Gronemeyer et al. | 222/521 |
| 3,216,630 | 11/1965 | Stull | 222/521 X |
| 3,549,060 | 12/1970 | Smylie | 222/521 X |
| 3,578,223 | 5/1971 | Armour | 222/521 |

*Primary Examiner*—Robert J. Spar
*Assistant Examiner*—Fred A. Silverberg
*Attorney, Agent, or Firm*—Harness, Dickey & Pierce

[57] ABSTRACT

A pour through stopper which permits dispensing of a liquid from a container without complete removal of the stopper. The construction is such that the stopper defines a dispensing passage through which the liquid passes when it is being poured. An improved sealing arrangement is provided for preventing the accidental discharge of liquid and for protecting and sealing the components of the stopper from the dispensed liquid.

9 Claims, 4 Drawing Figures

Fig. 1.
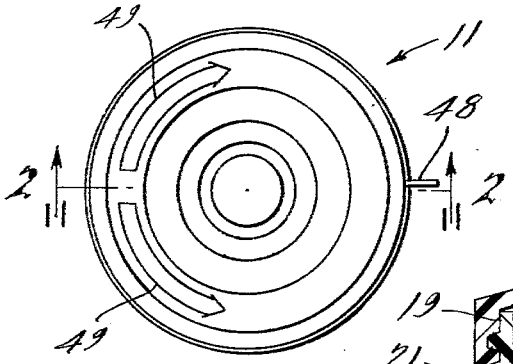
Fig. 2.
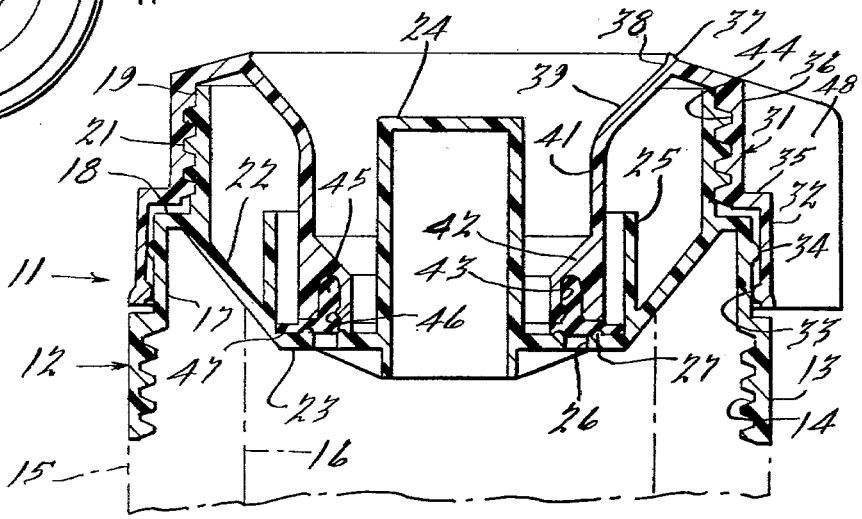
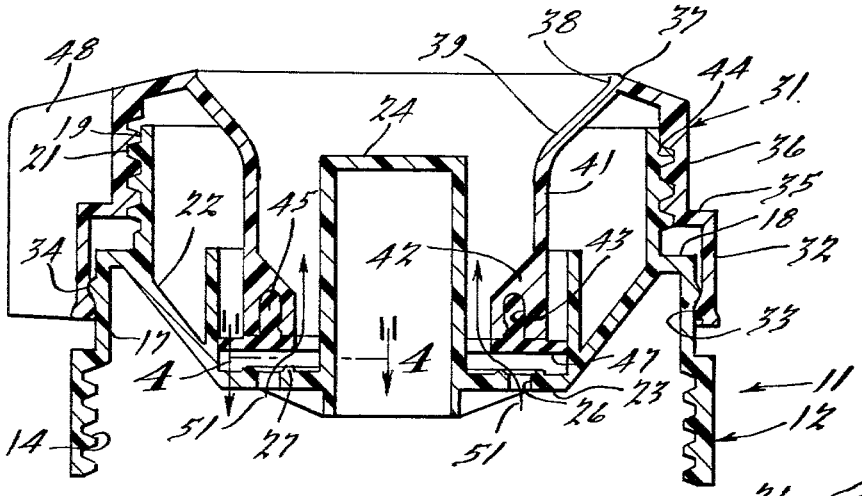
Fig. 3.
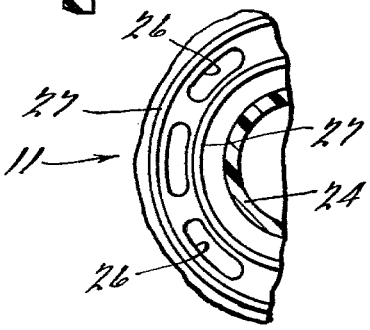
Fig. 4.

POUR THROUGH STOPPER

BACKGROUND OF THE INVENTION

This invention relates to a pour through stopper and more particularly to an improved construction for such a stopper.

A wide variety of pour through stopper designs have been proposed. Each of these previously proposed designs permits the dispensing of liquid from a container without complete removal of the stopper. The stopper includes a movable control element which when opened permits the liquid to be dispensed. One difficulty with all other previously proposed stoppers of this type is that the construction which supports the movable element is subject to exposure to the liquid being dispensed. This presents several problems, such as possible contamination, interference with the action of the spout with certain types of liquids and a less than satisfactory pouring relationship in some instances.

It is, therefore, a principal object of this invention to provide an improved pour through stopper.

It is another object of the invention to provide a pour through stopper in which the stopper elements define a definite discharge channel and in which an improved sealing arrangement is provided.

It is another object of the invention to provide an improved pour through stopper sealing arrangement wherein the elements which support the movable stopper element are protected from contact with the liquid being dispensed.

SUMMARY OF THE INVENTION

This invention is adapted to be embodied in a pour through stopper for dispensing liquid or the like from a container without necessitating removal of the stopper. The stopper has a first part that is adapted to be affixed to the container in registry with a discharge opening thereof and a second part supported for movement relative to the first part from a dispensing position to a sealing position. The first part defines an opening that is in registry with the discharge opening of the container so as to pass the contents of the container therethrough. The first part also defines a discharge channel that extends from the opening for directing the flow of the container contents from the opening. The second part has first sealing means that is adapted to sealingly engage the opening when the second part is in its sealing position relative to the first part. The second part also has second sealing means for sealingly engaging a portion of the discharge channel when the second part is in its dispensing position for defining a discharge path for the contents from the container.

BRIEF DESCRIPTION OF THE DRAWINGS

FIG. 1 is a top plan view of a pour through stopper embodying this invention.

FIG. 2 is an enlarged cross sectional view taken along the line 2—2 of FIG. 1.

FIG. 3 is a cross sectional view, in part similar to FIG. 2, showing the stopper in its dispensing position.

FIG. 4 is a cross sectional view taken along the line 4—4 of FIG. 3.

DETAILED DESCRIPTION OF THE PREFERRED EMBODIMENT

In the drawings the reference numeral 11 indicates generally a pour through stopper embodying this invention. The stopper 11, as will become apparent, is adapted to be affixed to any type of container, such as an insulated container, for facilitating the discharge of the liquid contents therefrom without necessitating complete removal of the stopper 11. The stopper 11 includes a first part, indicated generally by the reference numeral 12, and having a cylindrical skirt portion 13 which is formed with internal female threads 14. The threads 14 permit attachment of the part 12 to an associated container, as shown by the phantom lines 15 in FIG. 2 with the central portion of the part 12 in registry with the filling opening 16 of the container 15.

The skirt portion 13 of the part 12 has an upstanding cylindrical flange 17 that terminates in a horizontal shoulder 18. A second upstanding flange 19 extends from the inner periphery of the shoulder 18 and is formed with an external male threaded part 21. In addition to the upstanding flange 19, a downwardly extending generally conical section 22 is formed at the inner termination of the shoulder 18. The conical section 22 terminates in a horizontally extending wall 23 that extends across the mouth or opening 16 of the container 15 in the assembled position.

A generally hollow nose piece 24 extends upwardly from the center portion of the wall 23. The nose piece 24 is surrounded by an upstanding flange of cylindrical configuration 25 which is formed at the junction between the conical section 22 and the wall 23. The area between the cylindrical flange 25 and the nose piece 24 forms a discharge channel as will become apparent.

The area of the wall 23 between the nose piece 24 and the flange 25 is formed with a number of circumferential slots 26 which form openings through which the contents of the container 15 may flow during the dispensing cycle. Radially inwardly and outwardly of the slots 26 raised sealing ribs 27 are formed.

The pour through stopper 11 also includes a second piece, indicated generally by the reference numeral 31. The second piece 31 has a depending skirt 32 which encompasses the outer periphery of the flange 17 of the first piece 12. An inwardly extending rib 33 of the skirt 32 engages and seals against the periphery of the flange 17. A rib 34 of the flange 17 also sealingly engages the inner periphery of the skirt 32. In addition to providing the sealing function, the ribs 33 and 34 provide a positive stop to limit the opening movement of the piece 31 relative to the piece 12, as will become apparent.

At the upper end of the skirt portion 32, the piece 31 is formed with a horizontally extending shoulder 35. A cylindrical section 36 extends upwardly from the inner periphery of the shoulder 35 and is formed with an inwardly tapered upper end 37 which defines a discharge mouth 38. From the mouth 38, the piece 31 is formed with a downwardly tapering conical section 39 which, in turn, terminates in a downwardly extending skirt of cylindrical configuration 41. The lower end of the skirt 41 is formed with an enlarged thickness portion 42 that is formed with a downwardly facing groove 43. It should be noted that the enlarged portion 42 of the skirt 41 extends into the discharge channel formed by the nose piece 24 and flange 25 of the piece 12.

The inner periphery of the flange 36 of the piece 31 is formed with female threads 44 which engage the threads 21 of the piece 12. Thus, the piece 31 may be moved between a closed position (FIG. 2) and an open position (FIG. 3) by rotation of the pieces relative to each other by virtue of the screw threaded connection.

The engagement of the ribs 33 and 34 at the extreme outer end of this movement will prevent inadvertent removal of the piece 31 from the piece 12. The skirt 32 has sufficient flexibiltiy, however, so as to permit assembly of the pieces 31 and 12 during initial operation. In a like manner, the piece 31 may be removed from the piece 12 through outer deflection of the flange 32 to permit replacement of the seal, which seal will now be described.

A generally elastomeric seal of anular configuration and having an inverted T cross sectional shape is provided for both sealing the openings 26 and for providing a seal around the inner surface of the flange 25 so as to prevent contamination and to effectively define a discharge channel. This seal comprises an upstanding cylindrical portion 45 that is pressed into the groove 43 and is retained in this groove by means of a rib 46 formed with the groove's lower end. The seal also includes a generally planar section 47 that extends radially outwardly a sufficient distance so as to sealingly engage the inner surface of the flange 25. In the closed position, the lower surface of the seal portion 47 also is engaged by the ribs 27 so as to effectively seal the openings 26.

In order to facilitate operation of the spout 11, the piece 31 may be formed with an integral outstanding rib 48 that readily affords a device by which a user may rotate the piece 31. Also, a legend in the form of arrows 49 may be formed on the upper periphery of the portion 37 so as to indicate the directions of opening and closing of the device.

When the piece 31 is rotated to its closed position as shown in FIG. 2, the lower end of the seal part 47 will be engaged by sealing ribs 27 and the openings 26 will be effectively closed. In addition to providing for sealing, the ribs 27 add structural rigidity to the wall 23 so as to prevent its deflection. In addition to sealing in this area, the outer periphery of the seal portion 47 engages the inner periphery of the flange 25 so as to insure against the passage of any trapped liquid from the discharge channel into the area of the closure where the threads 21 and 44 are positioned. Thus, contamination will be prevented and the threads 21 and 44 will be protected from the liquid being dispensed.

When it is desired to dispense a liquid from the container 15, the piece 31 is rotated about the screw threaded connection 21, 44. Upon such rotation the seal part 47 will move away from the ribs 27 and openings 26 to the position shown in FIG. 3. The outer periphery of the seal part 47 will, however, still be sealingly engaged with the inner periphery of the flange 25 so as to prevent the contamination aforenoted and also so as to define a flow discharge channel as shown by the arrows 51 in FIG. 3 through which liquid may be poured from the container 15 without removal of the spout 11.

Upon closure of the spout 11 by rotation of the piece 31 in the opposite direction, the outer periphery of the seal part 47 will wipe any liquid from the inner wall of the flange 25 back through the openings 26. Thus, contamination is still further precluded.

The construction is such that the pieces 12 and 31 may be conveniently molded from plastic of any suitable type. Of course, other materials may be employed.

It should be readily apparent that the described construction provides a relatively simple and yet highly effective pour through stopper which has good sealing capabilities and in which the screw threads which support the two parts for relative movement are protected from engagement with the dispensed liquid. Various changes and modifications may be made without departing from the spirit and scope of the invention, as defined by the appended claims.

What is claimed is:

1. A pour through stopper for dispensing a fluent material from a container without necessitating removal of said stopper, said stopper having a first part adapted to be affixed to a container in registry with a discharge opening thereof and a second part supported for movement relative to said first part from a dispensing position to a sealing position, said first part having a first wall defining an opening therein in registry with the discharge opening of the container for passing the contents thereof, said first part further having a second annular wall extending outwardly from said first wall and defining a discharge channel extending from said opening for directing the flow of the container contents from said opening, said second part having first sealing means for directly sealingly engaging said first wall around said opening when said second part is in its sealing position relative to said first part for precluding the flow therethrough, said second part having an annular second sealing means for sealingly engaging said second annular wall around said discharge channel when said second part is in said dispensing position for defining a discharge path from the container for its contents, said annular second sealing means co-acting to return fluent material from said discharge channel through said discharge opening back into the container upon movement of said second part to its sealing position from its opened position.

2. A pour through stopper as described in claim 1 wherein the second part is movable relative to the first part along an axis parallel to that of the second wall and of the discharge channel.

3. A pour through stopper as described in claim 2 wherein the second part is supported for movement relative to the first part by a screw threaded connection for effecting axial movement upon relative rotation therebetween.

4. A pour through stopper as described in claim 1 wherein the first and second sealing means of the second part comprises a single sealing element.

5. A pour through stopper as described in claim 4 wherein the first sealing means of the single sealing element comprises a first surface thereof adapted to sealingly engage the first wall around the opening and the second sealing means comprises a second annular surface of said single sealing element adapted to sealingly engage second wall and the discharge channel.

6. A pour through stopper as described in claim 5 wherein the first part and the second part are movable relative to each other in an axial direction along an axis parallel to that of the discharge channel, the first and second parts being supported for movement relative to each other by a screw threaded connection for effecting axial movement upon relative rotation therebetween.

7. A pour through stopper as described in claim 1 wherein the first part further has a third wall extending from said first wall radially inwardly of said opening and parallel to said second wall.

8. A pour through stopper as described in claim 7 wherein the second part sealingly engages the second cylindrical wall in all positions of the second part relative to the first part.

9. A pour through stopper as described in claim 8 wherein the first part and the second part are movable relative to each other in an axial direction along an axis parallel to that of the discharge channel, the first and second parts being supported for movement relative to each other by a screw threaded connection for effecting axial movement upon relative rotation therebetween.

* * * * *